US011353211B2

(12) United States Patent
Pondo

(10) Patent No.: US 11,353,211 B2
(45) Date of Patent: Jun. 7, 2022

(54) HIGH TURNDOWN RATIO GASEOUS FUEL BURNER NOZZLE AND CONTROL

(71) Applicant: GAS TECHNOLOGY INSTITUTE, Des Plaines, IL (US)

(72) Inventor: Joseph Pondo, Bolingbrook, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 202 days.

(21) Appl. No.: 16/375,300

(22) Filed: Apr. 4, 2019

(65) Prior Publication Data

US 2019/0309941 A1 Oct. 10, 2019

Related U.S. Application Data

(60) Provisional application No. 62/654,880, filed on Apr. 9, 2018.

(51) Int. Cl.

| | |
|---|---|
| ***F23C 6/04*** | (2006.01) |
| ***F23C 3/00*** | (2006.01) |
| ***F23D 14/02*** | (2006.01) |
| ***F23D 14/60*** | (2006.01) |
| ***F23L 13/10*** | (2006.01) |

(52) U.S. Cl.

CPC ..... *F23C 6/045* (2013.01); *F23C 3/006* (2013.01); *F23D 14/02* (2013.01); *F23C 2900/03005* (2013.01); *F23D 14/60* (2013.01); *F23D 2900/00017* (2013.01)

(58) Field of Classification Search

CPC ..... F23C 2900/03005; F23C 3/006; F23C 6/045; F23D 14/02; F23D 14/60; F23D 2900/00017; F23D 2900/14481; F23L 13/10

See application file for complete search history.

(56) References Cited

U.S. PATENT DOCUMENTS 2,117,944 A * 5/1938 Cochrane ..... F23D 14/64 48/180.1
2,179,610 A * 11/1939 Breese ..... F23D 5/00 431/340

(Continued)

FOREIGN PATENT DOCUMENTS

FR 2800844 A1 * 5/2001 ..... F23D 11/402
GB 252042 A * 5/1926 ..... F23D 91/02

*Primary Examiner* — Michael G Hoang
*Assistant Examiner* — Logan P Jones
(74) *Attorney, Agent, or Firm* — Pauley Erickson & Swanson

(57) ABSTRACT

High turndown ratio gaseous fuel burner nozzles and the control thereof are provided. High turndown ratio gaseous fuel burner nozzles include a mechanically adjustable nozzle port, such as in the form of an iris port, for expanded turndown control. A nozzle extension longitudinally extending from the mechanical adjustable nozzle port can be included to assist in shaping the flow of combustible gas from the nozzle port. A laminar flow insert can be housed within the nozzle extension to assist in producing laminar flow of the combustible gas flowing therethrough. A burner nozzle controller in control communication with the mechanically adjustable nozzle port can adjust the size of the nozzle port to selectively maintain exit velocity of the gaseous fuel from the nozzle port for one or more of combustion stability and flame stability.

17 Claims, 5 Drawing Sheets

(56) References Cited

U.S. PATENT DOCUMENTS

| | | | | | |
|---|---|---|---|---|---|
| 2,181,261 | A * | 11/1939 | Breese | F23D 5/00 | 431/340 |
| 2,482,649 | A * | 9/1949 | Breese | F23D 5/00 | 122/17.2 |
| 3,224,682 | A * | 12/1965 | Paris | C08F 2/26 | 239/427.3 |
| 3,291,189 | A * | 12/1966 | Schade, Jr. | F23D 91/02 | 431/347 |
| 4,094,492 | A | 6/1978 | Beeman et al. | | |
| 4,266,930 | A * | 5/1981 | Leonard | F23N 5/24 | 126/41 R |
| 4,318,688 | A * | 3/1982 | Buschulte | F23D 11/402 | 431/114 |
| 4,583,936 | A * | 4/1986 | Krieger | F23D 14/64 | 431/1 |
| 5,158,261 | A * | 10/1992 | Morohoshi | F23D 11/26 | 251/129.15 |
| 5,370,526 | A * | 12/1994 | Buschulte | F23C 9/006 | 431/116 |
| 5,601,789 | A * | 2/1997 | Ruhl | F23D 14/62 | 422/168 |
| 5,609,833 | A * | 3/1997 | R uhl | F23D 14/02 | 422/173 |
| 5,618,173 | A * | 4/1997 | Ruhl | F23D 14/02 | 431/183 |
| 5,676,536 | A * | 10/1997 | Ruhl | F23D 14/62 | 431/5 |
| 6,413,080 | B1 * | 7/2002 | Fogliani | F23D 14/105 | 239/553 |
| 2003/0175638 | A1 * | 9/2003 | Stephens | F23D 14/04 | 431/9 |

* cited by examiner

HIGH TURNDOWN RATIO GASEOUS FUEL BURNER NOZZLE AND CONTROL

CROSS REFERENCE TO RELATED APPLICATION

This application claims the benefit of U.S. Provisional Patent Application, Ser. No. 62/654,880, filed on 9 Apr. 2018. This Provisional Application is hereby incorporated by reference herein in its entirety and is made a part hereof, including but not limited to those portions which specifically appear hereinafter.

BACKGROUND OF THE INVENTION

Field of the Invention

This invention relates generally to burner nozzles and, more particularly, to high turndown ratio gaseous fuel burner nozzles, also referred to herein as high turndown ratio gas burner nozzles, and the control thereof.

Description of Related Art

Typical burner nozzle operation is limited by low turndown ratio due to the use of a fixed port size on the gas burner nozzle. The fixed gas port size in a typical burner nozzle design results in combustion having a limited modulation range resulting in the burner being completely shutdown at low heat demand and then restarted to reduce the heat produced at low demand. Each re-fire of a burner results in additional heat losses due to safety purge requirements and equipment restart. Such on-off type of control at low heat demand also increases the duty of gas train components such as blocking valves which by code require a double block and bled that vents natural gas to the atmosphere.

Thus, there is a need and demand for a high turndown gas burner nozzle design such as would allow for single start up firing and greatly improved heat low matching of the burner to the heat demand.

Further, issues associated with conventional burner nozzle designs are mostly commonly centered on flame stability and noise. In normal burner operation, the speed of the air/gas mixture is somewhat higher than the flame speed. In such operation, the flame desirably stays anchored at or in the nozzle.

The velocity of primary air/gas flow from a nozzle can, however, increase at higher firing rates and can be greater than the flame speed. Under this condition, the flame lifts off from the burner nozzle and the flame burns at an elevated location spaced from the outer face of the burner nozzle. Operation of a burner under these conditions is a major cause of the burner noise associated with burner nozzles. On the other hand, operation under conditions with the velocity of the air/gas mixture being too slow, as compared to the flame speed, can undesirably result in the burning of the fuel air mixture within the burner nozzle itself. This condition can cause overheating and result in deterioration of the nozzle.

Thus, there is a need and demand for improvements in nozzle design, operation and control such as to allow a burner to operate at or near optimal conditions over a range of firing rates and such as resulting in one or more of:

1. Stable performance across a broader range of burner firing rates;
2. Increased turndown performance; and/or 3. Reduced emissions across a range of firing rates through increased flame control as compared to conventional fix port burner nozzles.

SUMMARY OF THE INVENTION

In accordance with one aspect of the subject development the invention provides a burner nozzle for natural gas, propane, hydrogen, or any other combustible gas, the burner nozzle having a mechanically adjustable port for expanded turndown control.

In accordance with another aspect of the subject development the invention provides methods or techniques for adjusting a mechanically adjustable nozzle port such as in the form of a mechanically adjustable iris port of a gaseous fuel burner nozzle.

A gaseous fuel burner nozzle in accordance with one embodiment desirably includes a mechanically adjustable iris nozzle port for expanded turndown control. The nozzle further includes a cylindrical nozzle extension longitudinally extending from and shaping flow of combustible gas from the mechanical adjustable iris nozzle port. The cylindrical nozzle extension including a laminar flow insert housed therewithin. The laminar flow insert desirably produces laminar flow of the combustible gas flowing therethrough.

In accordance with another embodiment, there is provided a gaseous fuel burner nozzle that includes a mechanically adjustable iris nozzle port for expanded turndown control. The burner nozzle also includes a cylindrical nozzle extension longitudinally extending from and shaping flow of combustible gas from the mechanical adjustable iris nozzle port. The cylindrical nozzle extension includes a laminar flow insert housed therewithin. The laminar flow insert desirably serves to result in or produce a laminar flow of the combustible gas flowing therethrough. The cylindrical nozzle extension includes a nozzle sidewall having a first proximal end portion disposed adjacent the mechanically adjustable iris nozzle port and an opposed second distal end portion forming a discharge end of the burner nozzle. In one preferred embodiment, the nozzle wall includes a plurality of recirculation ports disposed in the second distal end portion. The recirculation ports desirably serve to allow internal recirculation of at least a portion of exhaust gas produced by operation of the gaseous fuel burner nozzle. The burner nozzle further includes a burner nozzle controller in control communication with the mechanically adjustable iris nozzle port. The controller can desirably serve to adjust the size of the nozzle port to selectively maintain exit velocity of the gaseous fuel from the nozzle port for one or more of combustion stability and flame stability.

BRIEF DESCRIPTION OF THE DRAWINGS

Objects and features of this invention will be better understood from the following description taken in conjunction with the drawings, wherein.

DETAILED DESCRIPTION

The invention provides a gaseous fuel burner nozzle, such as in the form of either an overlapping or non-overlapping mechanically adjustable iris port, for expanded turndown control of a gaseous fuel, e.g., natural gas.

While the invention is described in greater detail below making specific reference to a gaseous fuel burner nozzle having or including a mechanically adjustable nozzle port in the form of a mechanically adjustable iris port, those skilled in the art and guided by the teachings herein provided will understand and appreciate that the broader practice of the invention is not necessarily limited to or with practice of an iris port, as other shapes or forms of mechanically adjustable nozzle ports may be suitably utilized in the practice of the invention and are herein encompassed.

Figure 1:
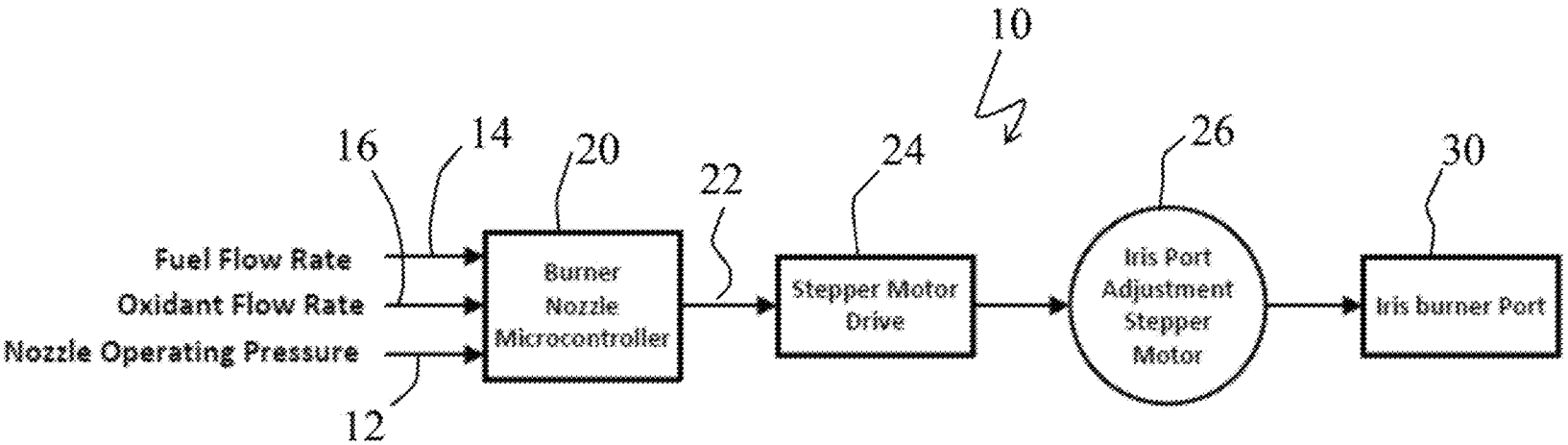
FIG. 1 is a simplified schematic supporting system operation in accordance with one aspect of the invention.

FIG. 1 is a simplified schematic supporting system operation in accordance with one aspect of the invention. In FIG. 1, a system generally designated by the reference numeral 10 is shown. As shown, the mechanical adjustable iris port can be desirably controlled/adjusted by entry of one or more and preferably by entry of each of the following parameters: pressure measurement (e.g., nozzle operating pressure) 12; fuel (e.g., natural gas) flow rate 14; and oxidant flow rate 16, for example, into a selected burner nozzle microcontroller 20. The burner nozzle microcontroller 20 in turn sends a signal 22 to stepper motor drive 24 or other selected motor element. The stepper motor drive 24 provides, produces or results in actuation of the iris port adjustment stepper motor or other selected motor element 26 to effect desired mechanical adjustment of the iris burner port 30.

Figure 2:
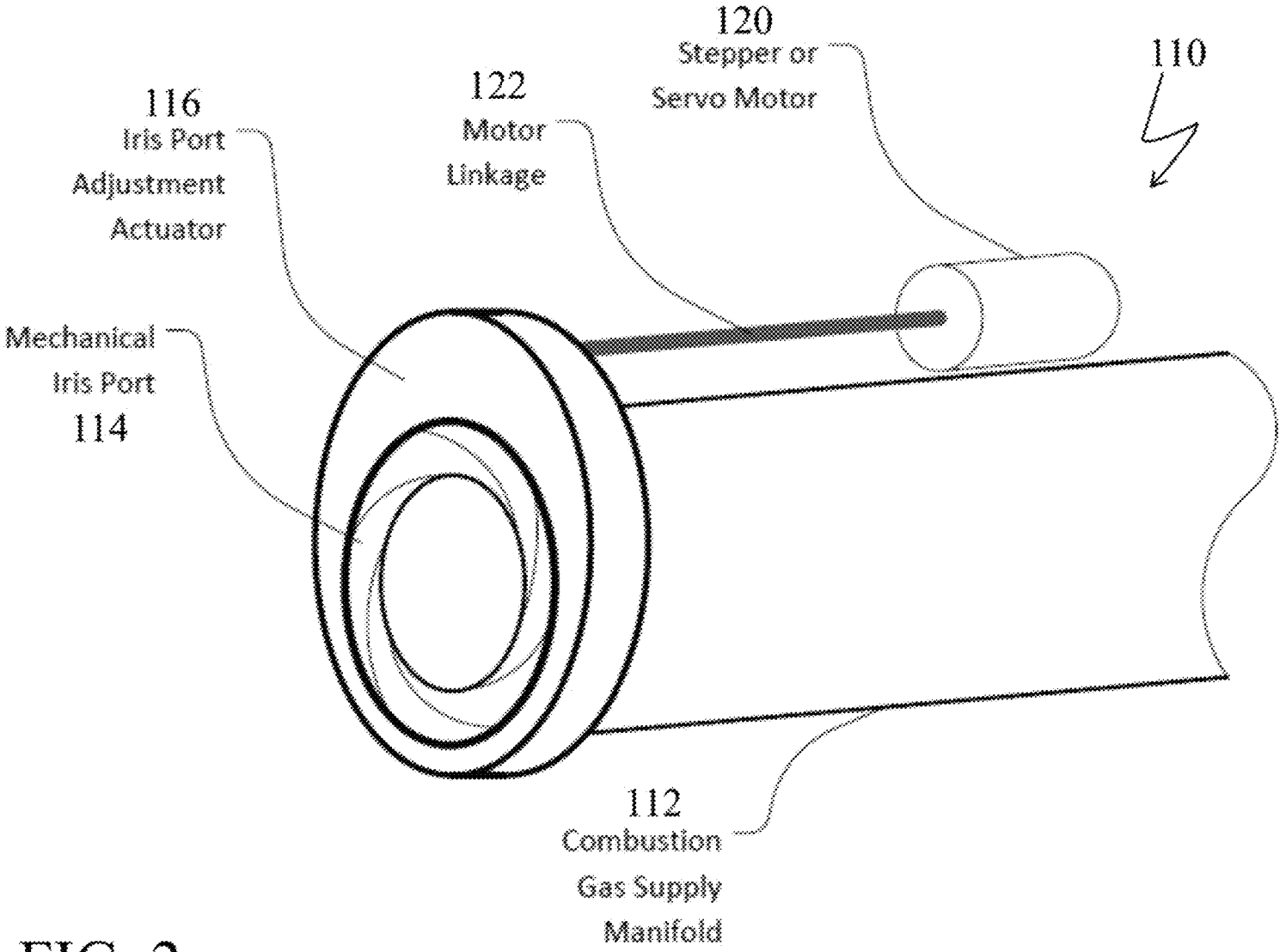
FIG. 2 is a simplified schematic showing the basic construction of a high turndown ratio gaseous fuel burner nozzle in accordance with one embodiment of the invention.

Turning to FIG. 2, there is shown a high turndown ratio gaseous fuel burner nozzle assembly 110 in accordance with one embodiment of the invention. More particularly, a combustion gas supply manifold 112 feeds into or terminates at a mechanical adjustable iris port 114. The mechanical iris port 114 is in contact or in communication with an iris port adjustment actuator 116. A motor element 120, such as a stepper or servo motor, is in actuating communication with the iris port adjustment actuator 116 via a motor linkage 122 or the like.

As identified above and in accordance with one preferred practice of the subject invention, the mechanical iris port can be desirably controlled/adjusted either by entry of pressure measurement or fuel gas and/or oxidant, e.g., combustion air, burner control signals and can be done in or through an open or close loop control system to maintain sufficient exit velocity such as required for stable combustion and flame stability.

Figure 3:
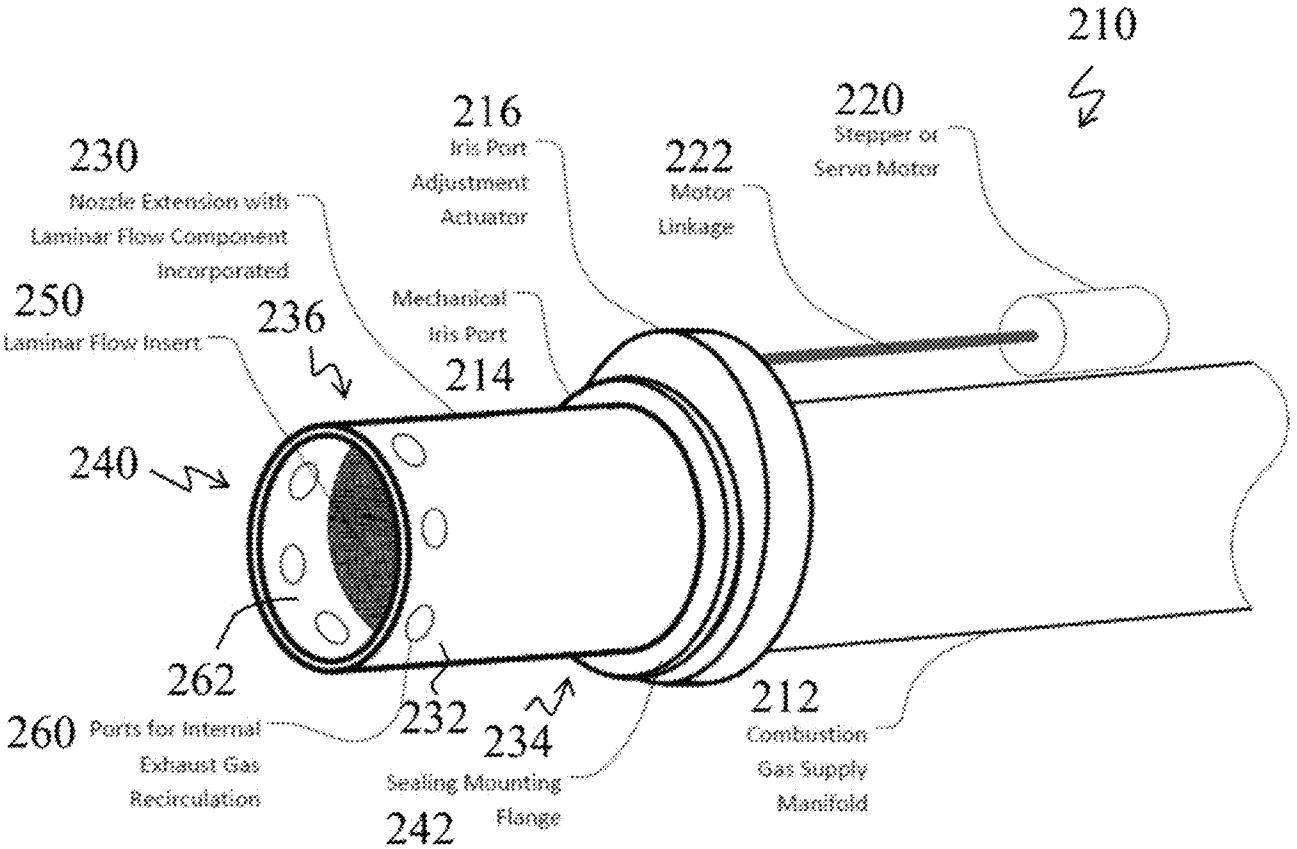
FIG. 3 is a simplified schematic showing the basic construction of a high turndown ratio gaseous fuel burner nozzle in accordance with another embodiment of the invention.

Turning now to FIG. 3, there is shown a high turndown ratio gaseous fuel burner nozzle assembly 210 in accordance with another embodiment of the invention. The high turndown ratio gaseous fuel burner nozzle assembly 210 is somewhat similar to the high turndown ratio gaseous fuel burner nozzle assembly 110 shown in FIG. 2 and described above in that the assembly 210. To that end, a combustion gas supply manifold 212 feeds into or terminates at a mechanical adjustable iris port 214. The mechanical iris port 214 is in contact or in communication with an iris port adjustment actuator 216. A motor element 220, such as a stepper or servo motor, is in actuating communication with the iris port adjustment actuator 216 via a motor linkage 222 or the like.

Figures 4, 5, 6:
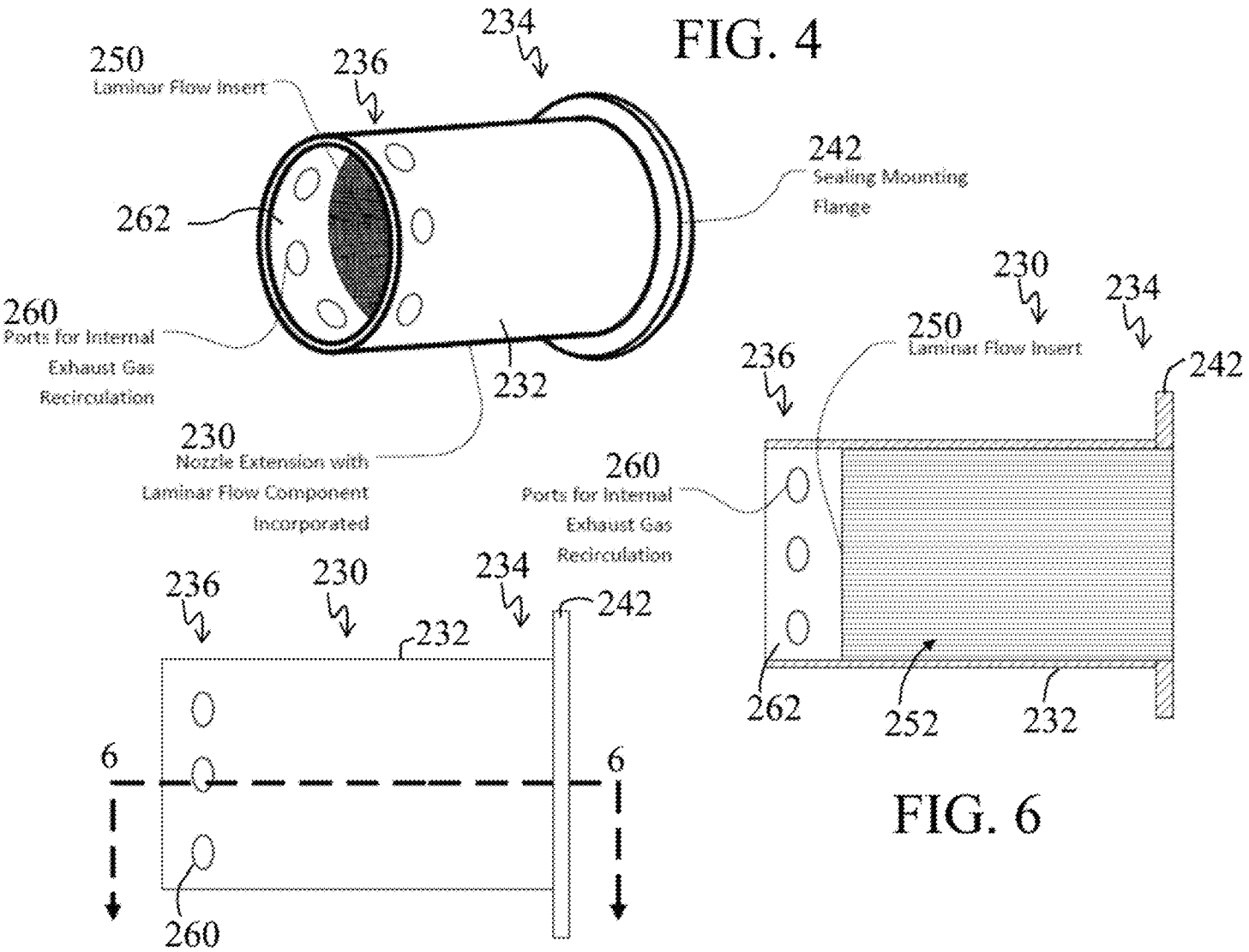
FIG. 4 is a perspective view of a gaseous fuel burner nozzle extension in accordance with one embodiment of the invention.
FIG. 5 is a side view of the gaseous fuel burner nozzle extension shown in FIG. 4.
FIG. 6 is a cross-sectional view of the gaseous fuel burner nozzle extension shown in FIG. 5 and taken along the line 6-6 shown in FIG. 5.

The high turndown ratio gaseous fuel burner nozzle assembly 210 primarily differs from the assembly 110 by the inclusion or incorporation of a nozzle extension 230, with the nozzle extension 230 shown in further detail in FIG. 4-6. The nozzle extension 230 includes or is at least in part composed of a cylindrical sidewall 232 having a first or proximal end portion 234 such as disposed adjacent the mechanically adjustable nozzle port 214 and an opposed second or distal end portion 236 such as forming a discharge end 240 of the burner nozzle assembly 210. As shown, the nozzle extension 230 may suitably include, contain or have associated therewith a sealing mounting flange 242 or the like at, adjacent or near the first or proximal end portion 234 and such as may serve to permit or facilitate attachment or placement of the nozzle extension 230 into operational placement relative to the mechanically adjustable nozzle port 214.

In accordance with one preferred embodiment, the nozzle extension is a static device and there is no linkage to the stepper motor/actuators. The single stepper motor, servo motor, or actuator and linkage or the like will generally serve to control the iris port opening size with the nozzle extension shaping the flow exiting the iris opening. The use of a nozzle extension desirably serves to move the flame and the associated higher temperatures away from mechanically adjustable port and thus allowing for reduced temperatures and wider selection of material of construction.

The mechanical nozzle port size can desirably be controlled based on parameters such as gas entry pressure to the nozzle; measurement of combustion gas flows; or position sensors of the combustion gas flow control valves. The nozzle controller would provide the signal to the stepper motor, servo motor, or actuator to adjust the required port size to maintain the optimal exit velocity required for desired flame performance and stable combustion.

If desired and as shown in accordance with one preferred embodiment, a laminar flow insert 250 can desirably be at least in part housed within the nozzle extension 230. The laminar flow insert 250 desirably serves to produce or result in laminar flow of the combustible gas flowing through the laminar flow insert 250 and the nozzle extension 230 and out from the assembly 210.

In accordance with one preferred embodiment, the laminar flow insert is desirably shaped or formed by a plurality of parallel narrow diameter tubes 252 such as in the form of a bundle and such as generally extending from the first or proximal end portion 234 to or towards the opposed second or distal end portion 236.

In one preferred practice of the invention, the inclusion and use of a laminar flow insert such as herein described will facilitate and/or allow the flow of the combustible gas to be tailored to achieve or result in desired flame shapes. Also the use of the extension may allow use of more conventional control type of mechanisms that do not necessarily produce a round shaped port opening such as a simple gate or shudder as the extension and flow insert will provide for shaping the flow exiting the port.

As will be appreciated by those skilled in the art and guided by the teaching herein provided, the laminar flow insert can be various forms or design to produce or result in laminar flow of the combustible gas flowing therethrough and the broader practice of the invention is not necessarily limited to or by the shape, form or construction of the laminar flow insert.

If desired and as shown, the nozzle extension sidewall 232 may include a plurality of recirculation ports 260 disposed in the second or distal end portion 236. The recirculation ports 260 desirably can serve to allow internal recirculation of at least a portion of exhaust gas produced by operation of the gaseous fuel burner nozzle. As shown, the laminar flow insert 250 may end short of the full length of the nozzle extension sidewall 232. Further the recirculation ports 260 can be spaced, and in one embodiment uniformly spaced, about the sidewall 232 at a margin portion 262 of the nozzle extension 230 extending beyond the length of the laminar flow insert 250.

While the illustrated embodiment depicts the recirculation ports 260 as being of generally uniform shape, size and spacing, the broader practice of the invention is not necessarily so limited. For example, those skilled in the art and guided by the teachings herein provided will understand and appreciate that, if desired, not only the number of recirculation ports but also parameters such as including shape, size, and spacing can be specifically tailored for particular or specific applications.

Figure 7:
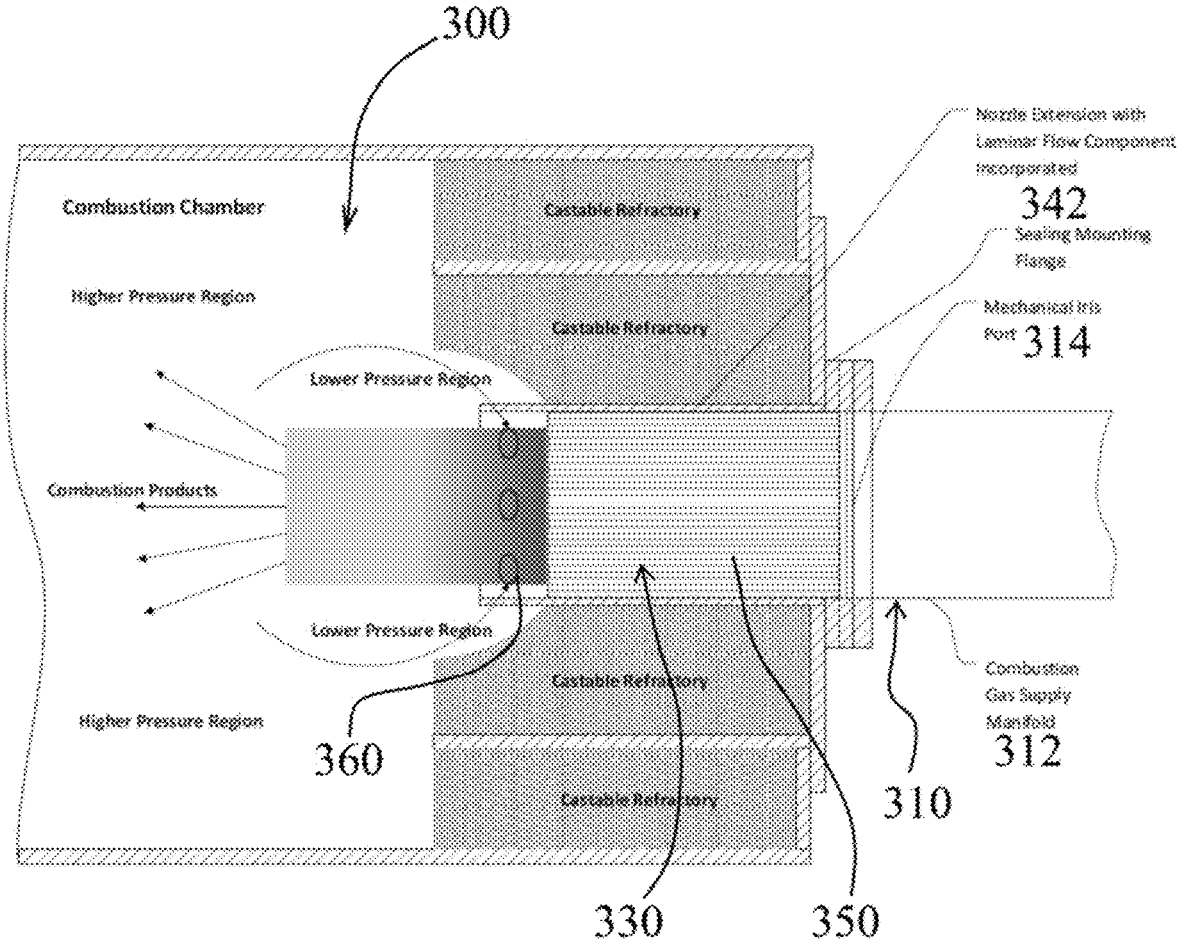
FIG. 7 is a side view of a combustion chamber having a high turndown ratio gaseous fuel burner nozzle installation in accordance with one embodiment of the invention

Turning to FIG. 7, there is shown a combustion chamber 300 incorporating a high turndown ratio gaseous fuel burner nozzle assembly 310 in accordance with one embodiment of the invention. The high turndown ratio gaseous fuel burner nozzle assembly 310 is generally similar to the high turndown ratio gaseous fuel burner nozzle assembly 210 shown in FIG. 3 and described above. To that end, a combustion gas supply manifold 312 feeds into or terminates at a mechanical adjustable nozzle port 314.

The high turndown ratio gaseous fuel burner nozzle assembly 310 includes or incorporates a nozzle extension 330 such as includes, contains or have associated therewith a sealing mounting flange 342 and such as may serve to permit or facilitate attachment or placement of the nozzle extension 330 into operational placement relative to the mechanically adjustable nozzle port 314.

The nozzle extension 330 further at least in part houses or contains a laminar flow insert 350. As shown, the laminar flow insert 350 desirably serves to produce or result in laminar flow of the combustible gas flowing through the laminar flow insert 350 and the nozzle extension 330 and out from the assembly 310.

The nozzle extension 330 further include a plurality of recirculation ports 360 such as may serve, as described above, to allow internal recirculation of at least a portion of exhaust gas produced by operation of the gaseous fuel burner nozzle, such as shown in FIG. 7.

As will be appreciated by those skilled in the art and guided by the teachings herein provided, high turndown gas burner nozzle design can allow for single start up firing and greatly improved heat flow matching of the burner to the heat demand.

Such designed combustible gas burners can desirably provide or result in:

1. stable combustion and flame stability over a wide operation range with improved control at any desired operating point;
2. continuous flame control with no shut down and re-light cycles at lower heat load demand operations;
3. increased operational efficiency such as due to the elimination of heat losses associated with on/off control of the burner system; and
4. decreased number of burner systems required to cover each market segment.

More specifically, for example, the added capability to control the nozzle port size during operation will facilitate and permit burner operation at or near optimal conditions over a range of firing rates resulting in satisfaction or one or more and preferably each of the following operational results: stable performance across a broader range of burner firing rates; increased turndown performance with a target of greater than 20:1; and reduced emissions across firing rates compared to a fix port nozzle through increased flame control from the adjustable port size of the burner nozzle.

Further, the incorporation and utilization of mechanically adjustable nozzle ports such as herein provided enables and facilitates utilization of advanced operational controls, such as the adaptive control modules currently used in the automotive industry to adjust to maintain performance and emissions limits.

Thus in accordance with at least selected embodiments, the invention desirably results or produces improvements in efficiency and overall burner nozzle performance as well as reduction in emissions across a wider operating range as compared to the current fix port nozzles burners design.

While, as compared to fixed port burner nozzles, increased costs may result from increased complexity of the nozzle design and to the controls required for proper operation, as a result of the recent acceleration in development of motion control technology for automation these components have dramatically decreased in cost and can be expected to continue to do so in the foreseeable future.

While the invention has been described above making specific reference to embodiments employing natural gas as the fuel or combustible gas, the broader practice of the invention is not necessarily so limited. For example, if desired, the invention can be applied or practiced in conjunction with or using other fuel or combustible gas including propane, methane and hydrogen, for example.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed includes:

1. A burner nozzle for a gaseous fuel burner, the gaseous fuel burner nozzle comprising:

a manifold configured to deliver a combustible mixture of an oxidant and a fuel gas; and a mechanically adjustable nozzle port at an end of the manifold and configured for expanded turndown control of the combustible mixture from the nozzle port, wherein the mechanically adjustable nozzle port is a mechanically adjustable iris port; and a laminar flow element comprising a bundle of a plurality of parallel tubes each extending from a first proximal end that is disposed abutting the mechanically adjustable iris nozzle port, toward an opposed second distal end, wherein the mechanically adjustable iris nozzle port is configured to adjust a flow of the combustible mixture through the plurality of parallel tubes to adjust a flame shape.

2. The gaseous fuel burner nozzle of claim 1 wherein the burner operates on a gaseous fuel selected from the group consisting of natural gas, propane, hydrogen and mixtures thereof.

3. The gaseous fuel burner nozzle of claim 1 additionally comprising:

a nozzle extension longitudinally extending from and shaping flow of the combustible mixture from the mechanical adjustable nozzle port.

4. The gaseous fuel burner nozzle of claim 3 wherein the nozzle extension includes the laminar flow element housed therewithin, and the laminar flow element producing laminar flow of the combustible mixture flowing therethrough.

5. The gaseous fuel burner nozzle of claim 3 wherein the nozzle extension comprises a cylindrical sidewall having a first proximal end portion disposed adjacent the mechanically adjustable nozzle port and an opposed second distal end portion forming a discharge end of the burner nozzle, wherein the nozzle wall includes a plurality of recirculation ports disposed in the second distal end portion, the recirculation ports allowing internal recirculation of at least a portion of exhaust gas produced by operation of the gaseous fuel burner nozzle.

6. The gaseous fuel burner nozzle of claim 1 additionally comprising a burner nozzle controller in control communication with the mechanically adjustable nozzle port to adjust the size of the nozzle port to selectively maintain exit velocity of the combustible mixture from the nozzle port.

7. The gaseous fuel burner nozzle of claim 6 wherein the exit velocity of the combustible mixture from the nozzle port is maintained for stable combustion.

8. The gaseous fuel burner nozzle of claim 6 wherein the exit velocity of the combustible mixture from the nozzle port is maintained for flame stability.

9. The gaseous fuel burner nozzle of claim 6 wherein the burner nozzle controller adjusts nozzle port opening size based on a parameter selected from the group consisting of entry pressure, a fuel gas burner control signal, an oxidant burner control signal and combinations thereof.

10. The gaseous fuel burner nozzle of claim 1 controlled by entry of at least one parameter selected from the group of pressure measurement, fuel flow rate and oxidant flow rate, into a nozzle controller to change the size of the mechanically adjustable nozzle port.

11. A gaseous fuel burner nozzle comprising:

a manifold configured to deliver a combustible mixture of an oxidant and a fuel gas;

a mechanically adjustable iris nozzle port at an end of the manifold and configured for expanded turndown control of the combustible mixture from the nozzle port; and a cylindrical nozzle extension longitudinally extending from and shaping flow of combustible gas from the mechanical adjustable iris nozzle port, the cylindrical nozzle extension including a laminar flow insert housed therewithin, the laminar flow insert comprising a bundle of a plurality of parallel tubes each extending from a first proximal end that is disposed abutting the mechanically adjustable iris nozzle port, toward an opposed second distal end, the laminar flow insert producing laminar flow of the combustible mixture flowing therethrough and wherein the mechanically adjustable iris nozzle port is configured to adjust a flow of the combustible mixture through the plurality of parallel tubes to control a flame shape.

12. The gaseous fuel burner nozzle of claim 11 wherein the cylindrical nozzle extension comprises a nozzle wall including a first proximal end portion disposed adjacent the mechanically adjustable iris nozzle port and an opposed second distal end portion forming a discharge end of the burner nozzle, wherein the nozzle wall includes a plurality of recirculation ports disposed in the second distal end portion, the recirculation ports allowing internal recirculation of at least a portion of exhaust gas produced by operation of the gaseous fuel burner nozzle.

13. The gaseous fuel burner nozzle of claim 11 additionally comprising a burner nozzle controller in control communication with the mechanically adjustable iris nozzle port to adjust the size of the nozzle port to selectively maintain exit velocity of the combustible mixture from the nozzle port for one or more of combustion stability and flame stability.

14. The gaseous fuel burner nozzle of claim 13 controlled by entry of at least one parameter selected from the group of pressure measurement, fuel flow rate and oxidant flow rate, into the burner nozzle controller to adjust the size of the nozzle port.

15. A gaseous fuel burner nozzle comprising:

a manifold configured to deliver a combustible mixture of an oxidant and a fuel gas; and a mechanically adjustable iris nozzle port at an end of the manifold and configured for expanded turndown control of the combustible mixture from the nozzle port;

a cylindrical nozzle extension longitudinally extending from and shaping flow of combustible gas from the mechanical adjustable iris nozzle port, the cylindrical nozzle extension including a laminar flow insert housed therewithin, the laminar flow insert producing laminar flow of the combustible gas flowing therethrough, the cylindrical nozzle extension including a nozzle wall having a first proximal end portion disposed adjacent the mechanically adjustable iris nozzle port and an opposed second distal end portion forming a discharge end of the burner nozzle, wherein the nozzle wall includes a plurality of recirculation ports disposed in the second distal end portion, the recirculation ports allowing internal recirculation of at least a portion of exhaust gas produced by operation of the gaseous fuel burner nozzle;

the laminar flow insert comprising a bundle of a plurality of parallel narrow diameter tubes each extending from a first proximal tube end that is disposed abutting the mechanically adjustable iris nozzle port, toward an opposed second distal tube end, wherein the mechanically adjustable iris nozzle port is configured to adjust a flow of the combustible mixture through the plurality of parallel tubes to adjust a flame shape; and a burner nozzle controller in control communication with the mechanically adjustable iris nozzle port to adjust the size of the nozzle port to selectively maintain exit velocity of the combustible mixture from the nozzle port for one or more of combustion stability and flame shape and stability.

16. The gaseous fuel burner nozzle of claim 15 wherein the burner operates on a gaseous fuel selected from the group consisting of natural gas, propane, hydrogen and mixtures thereof.

17. The gaseous fuel burner nozzle of claim 15 controlled by entry of at least one parameter selected from the group of pressure measurement, fuel flow rate and oxidant flow rate, into the burner nozzle controller to adjust the size of the nozzle port.

* * * * *